US007096812B1

(12) United States Patent
Cook et al.

(10) Patent No.: US 7,096,812 B1
(45) Date of Patent: Aug. 29, 2006

(54) AERODYNAMIC HEADSTAY FOIL

(76) Inventors: Fred C Cook, 59 Cliff Dr., Assonet, MA (US) 02702; David R Dion, 12 Olde Logging Rd., Marion, MA (US) 02378; Paul Bogotaj, 4223 70th Ave. Ct. NW., Gig Harbor, WA (US) 98335

( * ) Notice: Subject to any disclaimer, the term of this patent is extended or adjusted under 35 U.S.C. 154(b) by 0 days.

(21) Appl. No.: 11/161,038

(22) Filed: Jul. 20, 2005

(51) Int. Cl.
*B63H 9/04* (2006.01)

(52) U.S. Cl. ..... 114/105; 114/108

(58) Field of Classification Search ..... 114/102.1, 114/102.14, 102.15, 105, 106, 108, 39.32
See application file for complete search history.

(56) References Cited

U.S. PATENT DOCUMENTS

| | | | | |
|---|---|---|---|---|
| 3,802,373 A | | 4/1974 | Lagerquist | 114/105 |
| 3,851,609 A | | 12/1974 | Stearn | 114/105 |
| 3,866,558 A | | 2/1975 | Bergstrom | 114/90 |
| 3,927,633 A | | 12/1975 | Bernard | 114/105 |
| 3,948,200 A | | 4/1976 | Hood | 114/105 |
| 4,340,005 A | * | 7/1982 | Lagerquist | 114/105 |
| RE31,829 E | * | 2/1985 | Stearn | 114/105 |
| 4,619,216 A | | 10/1986 | Crear | 114/105 |
| 4,646,671 A | | 3/1987 | Innes | 114/103 |
| 4,947,776 A | | 8/1990 | Peterson | 114/102 |
| 5,109,787 A | | 5/1992 | Peterson | 114/102 |
| 6,141,809 A | | 11/2000 | Lyngholm | 114/102 |

* cited by examiner

*Primary Examiner*—Lars A. Olson
(74) *Attorney, Agent, or Firm*—Mark P. White

(57) ABSTRACT

A foil for the headsail of a sailboat for use with a headstay has an aerodynamic shape. It includes a headstay channel for containing the headstay, which may be snapped into place in the channel. The foil has a first and second sidewall, a forward wall, and two or more tabs on the back of the forward wall, which engage the headstay. A forward luff channel is bounded one side by the first side wall and on an other side by a forward channel inner wall. An aft luff channel isbounded on one side by the second side wall and on an other side by an aft channel inner wall. Fairing tabs are affixed to an end of the first side wall, to an end of the second side wall, and to an end of an aft channel inner wall.

8 Claims, 10 Drawing Sheets

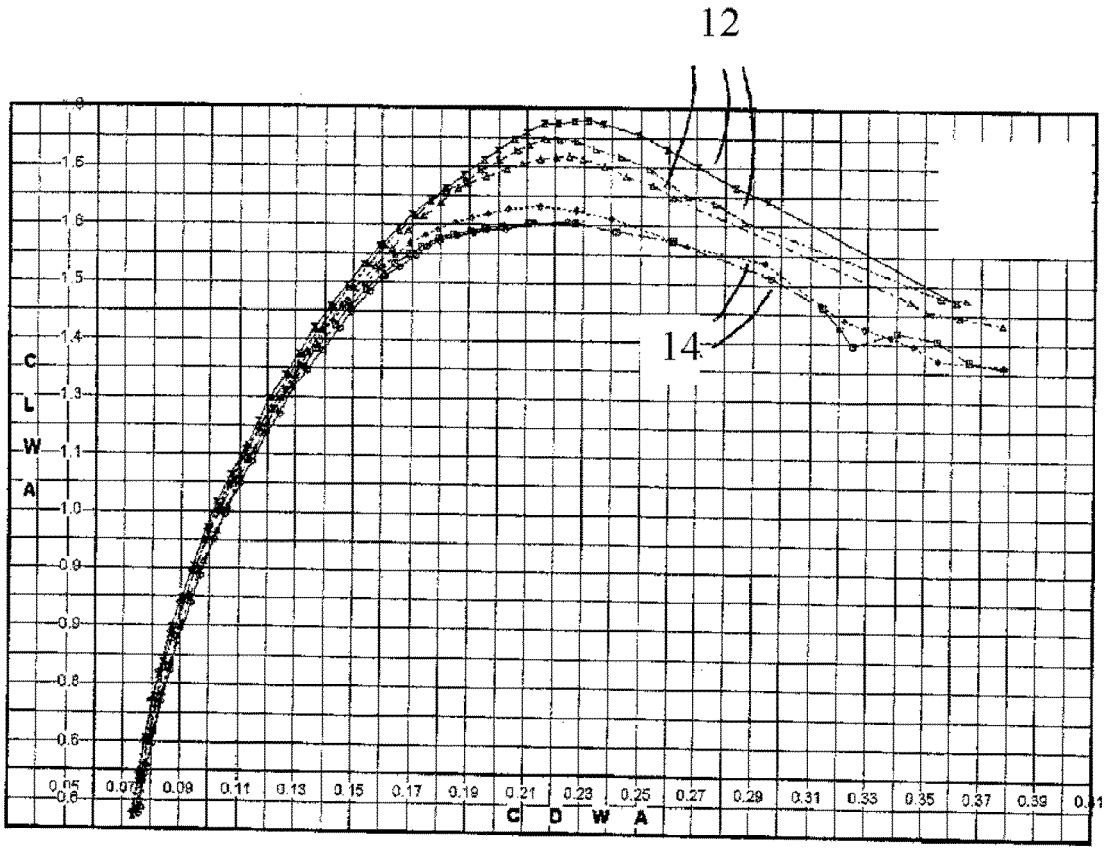
Fig. 4C Lift versus drag comparison

FOIL WIDTH AS A PERCENTAGE OF CHORD LENGTH

| LOCATION | WIDTH (%-CHORD LENGTH) |
|---|---|
| 10% LENGTH | 26% |
| 20% LENGTH | 33% |
| 40% LENGTH | 38% |
| 60% LENGTH | 36% |
| 80% LENGTH | 30% |
| 90% LENGTH | 21% |

AERODYNAMIC HEADSTAY FOIL

PRIOR ART

The present invention is directed to improving the air flow over the surface of a staysail, or jib, particularly the headsail in a sailboat, and reducing the air turbulence in the vicinity of the luff of the sailboat by use of an aerodynamic luff member, or foil, which holds the luff of the sail and maintains an attachment of said sail luff to the stay which supports the sail.

It has long been known that maintaining laminar airflow over the leading edge of a sail on a sailboat improves the boat's performance. A number of patents have disclosed streamline luff foils for this purpose.

A typical foil of this kind is shown in FIG. 1 (prior art), which appears in U.S. Pat. No. 3,802,373, in which a sailboat has the jib 104 affixed to the headstay 106 by means of such a foil 126. This prior art device will be briefly summarized herein, since it demonstrates the general features of simple luff foils, or extrusions, as the foils are sometimes called, since they are generally formed by the extrusion process.

Referring to this figure, it is seen that the headstay, or forestay 106 extends substantially from the bow of the vessel to the masthead 108. At the bow end, the headstay 106 is affixed to the bow plate 124 by means of a turnbuckle 120. A cap 184 is affixed at the mast-head end of the foil. A feeder 144 is affixed to the lower end of the foil. This figure further shows the luff bolt 230 as it enters the feeder 144.

The lower end of the foil is shown in more detail in FIG. 2 (prior art) as disclosed in U.S. Pat. No. 4,619,216. The luff bolt 230 of the jib 104 is shown entering the foil 126 by means of the feeder 144. A pre-feeder 244 guides the lower end of the luff bolt 230. Also shown in this figure is the reinforcing tape 228 which affixes the luff bolt to the jib.

FIGS. 3A and B (prior art) show the prior art foil whose cross section is more or less constant over the length of the foil. The headstay 6 is captured by a headstay channel 7 in the forward part of the foil, while the luff ropes 34, which are affixed to the foresails 104, are captured in the luff channels 9 aft of the headstay.

The use of such foils for affixing the jibs of sailboats is currently commonplace for a number of reasons. The mainsails of modern sailboats are generally affixed in a similar manner, at the foot to a slot running the length of the boom, and at the luff to a slot running the length of the mast. When, as is common, the sailboat utilizes a roller furler or roller reefer for its foresails, the jib is usually (but not always) affixed at the luff to a foil or extrusion which rotates about the jib stay.

Some sailboats which utilize roller furling mainsails also use foils to affix the luff of the mainsail to the mast. See, for example, U.S. Pat. No. 4,821,664. The problem of maintaining a laminar airflow about the luff of the mainsail does not appear to be as critical a problem as at the luff of the jib, however, because air is directed from the leech, or trailing end of the jib, to the side of the front area of mainsail, and does not strike the mast or mainsail luff straight on.

The method of rigging modern jibs has taken a step further, however, in that modern usage is to rig two different jibs on a single jib foil having two parallel slots running the length of the foil. U.S. Pat. No. 4,619,216 is an example of such a foil.

The foil shown in this last patent is clearly not very aerodynamically shaped. FIG. 3C (Prior Art) shows the airflow around the body 201 of this prior art foil. At reference number 200, at the side of the prior art foil, the flow forms a "bubble", which destroys the desired laminar flow.

Especially in racing sailboats, small improvements in maintaining the laminar flow at the front of the jib can make the difference between winning and losing races. The present invention provides a foil which produces a minimum amount of turbulence in proximity to the luff 231 of the jib 104, as shown in FIG. 1, where airflow is most important. This foil is used in conjunction with the most advanced feeder systems of the prior art, and is disclosed, in the preferred embodiment, as formed from a compliant plastic which allows the foil to be easily attached to the headstay already rigged, with a minimum of effort, and without requiring special tools, allowing for easy removal and reinstallation as well.

SUMMARY OF THE INVENTION

It is an object of the present invention to provide an aerodynamic foil for the headsail of a sailboat. It is a further object of this invention that the foil be light weight, and easy to affix to the headstay, and to remove from the headstay.

In accordance with a first aspect of the invention, the foil includes a headstay channel for containing the headstay, and a first and second sidewall, each having a width w.

In accordance with a second aspect of the invention, the headstay further includes a forward wall having a width wf.

In accordance with a third aspect of the invention the headstay includes two or more tabs which have a width, when added to wf, approximately eaquls 2w.

In accordance with a fourth aspect of the invention the foil includes a forward luff channel bounded one side by the first side wall and on an other side by a forward channel inner wall.

In accordance with a fifth aspect of the invention the foil includes an aft luff channel bounded on one side by the second side wall and on an other side by an aft channel inner wall.

In accordance with a sixth aspect of the invention the foil includes a forward fairing tab affixed to an end of the first side wall.

In accordance with a seventh aspect of the invention the foil includes two aft fairing tabs, one affixed to an end of the second side wall, and the other affixed to an end of an aft channel inner wall.

In accordance with an eighth aspect of the invention the forward wall has a diameter less than or equal to the diameter of the headstay.

In accordance with a ninth aspect of the invention the foil has a chord length, wherein the diameter of the forward wall is 13% of the chord length, plus or minus ten percent.

In accordance with a tenth aspect of the invention the diameter of the forward wall is 13% of the chord length, plus or minus twenty percent.

In accordance with an eleventh aspect of the invention the foil has a cross-sectional outline, the outline having a nose, a width and a major axis, the width having a value as follows, within plus or minus 10%, as measured as a length from the nose:

(a) 26% of the chord length at a distance of 10% chord length;

(b) 33% of the chord length at a distance of 20% chord length;

(c) 38% of the chord length at a distance of 40% chord length;

(d) 36% of the chord length at a distance of 60% chord length;

(e) 30% of the chord length at a distance of 80% chord length; and (f) 21% of the chord length at a distance of 90% chord length.

In accordance with a twelfth aspect of the invention the chord lengths are maintained to within plus or minus 20%, as measured as a length from the nose:

In accordance with a final aspect of the invention the foil outlines substantially conform to a NACA aerodynamic form.

BRIEF DESCRIPTION OF DRAWINGS

These, and further features of the invention, may be better understood with reference to the accompanying specification and drawings depicting the preferred embodiment, in which:

FIG. 4C depicts a plot of lift versus drag of the foils tested.

DISCLOSURE OF THE INVENTION

In order to determine optimum cross section shape for a foil, extensive tests have been performed in a wind tunnel, both on existing foils, and proposed variations of the cross section of the present invention.

The prior-art Tuff-Luff® headfoil and several other headfoils were analyzed using computational fluid dynamics (CFD). A wind tunnel test was conducted to compare the various existing headfoil designs with the present design. The test results confirmed that the current design had better performance than the existing design. Flow visualization demonstrated that the improvement was due to eliminating separated flow on the headfoil.

Figure 4A:
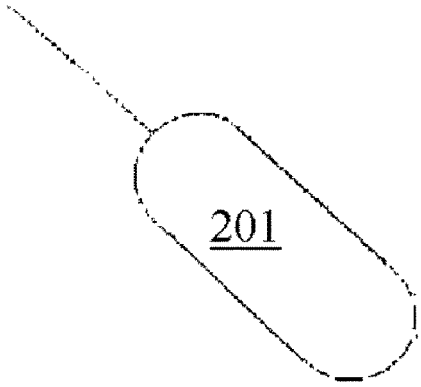
Fig. 4A (Prior Art)
FIG. 4A (Prior Art) depicts the prior art headfoil shape that was provided for analysis.
Figure 4B:
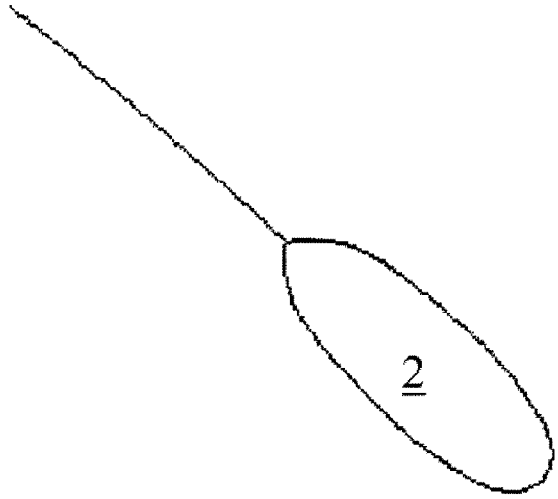
FIG. 4B depicts the outline of the present headfoil shape that was provided for analysis.

Two of the headfoil shapes that were provided for analysis are shown in FIGS. 4A and 4B. The foils of FIGS. 4*a* and 4*b* are referred to, respectively, as foil 1 and foil 2. Foil 2 is the foil of the present invention.

In order to compare the performance of the different shapes, a sail was attached to the back edge of each. The sail was at five degrees angle of attack, and the headfoil was oriented parallel to the leading edge of the sail.

The headfoils with the sail attached were analyzed in XFOIL at Reynolds number of 2,000,000, which represents a moderate wind speed for a medium size boat. Recognizing that since the sail chord varies significantly along the span of a foresail, and that boats sail in a wide range of wind conditions, this condition was chosen to represent the middle of the possible range of Reynolds numbers.

The results are plotted in FIG. 4C as lift (CLWA) versus drag (CDWA). The top three lines 12 show the results for three trials of foil 2, while the others 14 show the results for foil 1. It is apparent that foil 1 has more drag than foil 2 for the same lift levels. Further wind tunnel tests proved that foil 2 maintains lift at higher angles of attack than foil 1.

The reason that foil 1 has higher drag at higher lift coefficients and does not develop as much maximum lift as the new headfoil was clearly displayed by flow visualizations used during these tests. These visualizations showed where the flow separates from the headfoil. Areas downstream showed re-circulating flow where all of the particles had been swept back forward to collect in the yellow band. This behavior is referred to as a separation bubble, the laminar-flow destroying effect shown in FIG. 3C.

The present patent discloses a foil having an outer profile which is substantially similar to the outline cross section shown in FIG. 4B.

Figure 5:
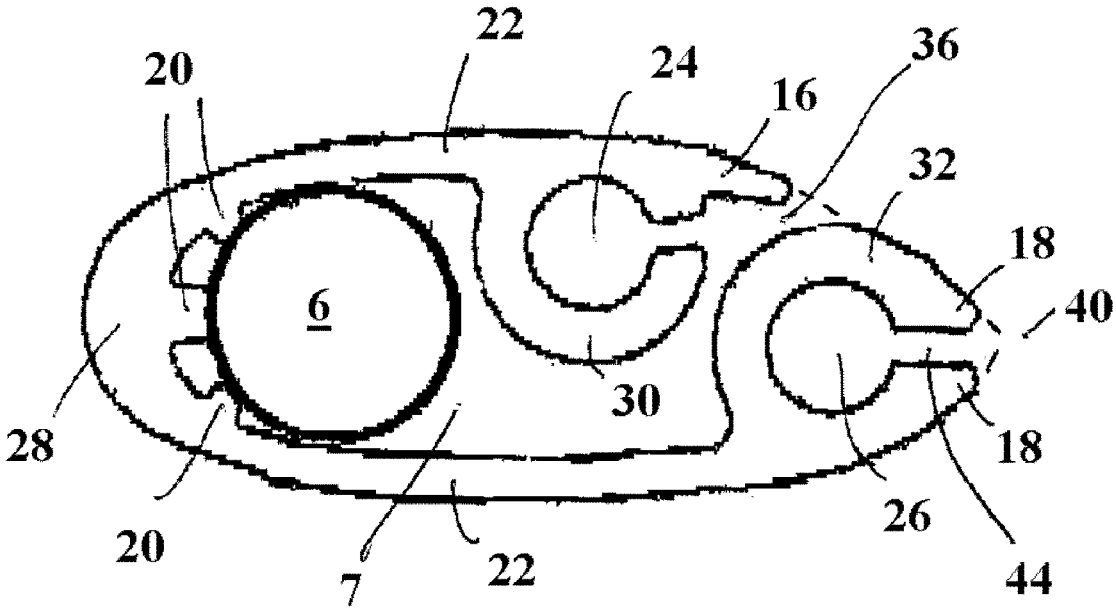
FIG. 5 depicts a detailed cross section of the present foil.

The present foil is shown in cross-sectional detail view in FIG. 5. The foil contains two channels 24, 26 for retaining the luff ropes or beads of two headsails, and a further internal area or channel 22 for retaining the headstays, which may be seen by referring to FIG. 5.

There are, in practice, a number of different profiles which will provide reasonably aerodynamic characteristics to a headstay foil. Various aerodynamic forms have been studied and compiled for many years, including the NACA compilations of airfoils for use in aviation, described in *Aerodynamic characteristics of a large number of airfoils tested in the variable-density wind tunnel*, report-628, Pinkerton and Greenberg 1938. (NACA, the National Advisory Committee for Aeronautics, was the predecessor of NASA, created in 1958.) These "NACA" standard shapes have generally been conceived for use in flight, rather than for marine applications. However, it has long been recognized that the physics of sailing are quite similar to those of flight, and modern marine technology makes extensive use of the science of aerodynamics and fluid dynamics in the design of hulls, sails, and other components of vessels which relate to fluid flow and air flow. See also Rudder Design and Construction, www.solarnavigator.net (not a hyperlink).

However, there are a number of competing requirements in the case of an aerodynamic form for the present application for use on the headstay of a sailboat, which do not exist in other applications.

First, there is the problem of windage, or drag, created by the foil, as the air flows around it as the sailboat proceeds forward. Windage can only act to slow the boat down, and it is highly dependent upon the width of the foil. Thus the foil must be as narrow as possible.

Second, the efficiency of the foil increases as the foil is pushed forward from the headstay. However, the foil can only be pushed so far forward before it begins to encroach upon the area where the forward luff channel resides.

Next, the length of the foil should be made as short as possible, because of racing rules in which a penalty is paid dependent upon the length of the foil cross section.

The preferred embodiment of the present invention is shown in FIG. 5. This embodiment has an aerodynamic form, in accordance with the NACA standards, and has been tested in wind tunnel experiments which confirm that it has a superior lift to drag ratio. This embodiment further incorporates all the important limitations on foil design, other than aerodynamic cross section, arising out of its use in high-performance and racing sailboats.

Referring now to this figure, the foil of the current invention has a forward wall 28 which merges into outer walls 22 on either side. One of the outer walls 22 merges with the forward luff channel 24 surrounding structure, while the other outer wall 22 merges with the aft luff channel 26 surrounding structure. The forward luff channel fairing 16 minimizes turbulence caused by the forward luff channel entry 36 slot. Similarly the aft luff channel fairings 18 minimized turbulence caused by the aft luff channel entry slot 44. The forward luff channel 24 is generally bounded by the outer wall 22 on one side, and the semi-circular forward channel inner wall 30 on the other side. In a similar manner the aft luff channel 26 is bounded by the opposite outer wall 22, and semi-circular aft channel inner wall 32. The dotted lines in this figure show the limits of the outline of foil's cross section, which generally conforms to the outline of the optimum foil of the wind tunnel tests, previously referred to as foil 2, and which appears in FIGS. 4B and 7A.

The foil is extruded from a tough, resilient, but flexible material, generally any one of several thermoset or thermoplastic materials, including PVC, which allows the capture of the head stay 6 by forcing the forward luff channel 24 structure away from the aft luff channel 26 structure, so that the forward luff channel entry slot 36 widens sufficiently to allow the headstay 6 to pass into the headstay channel 7, as shown in FIG. 5. The material also possesses sufficient elastic memory to allow the foil to return to its original shape after capturing the headstay.

Figure 1:
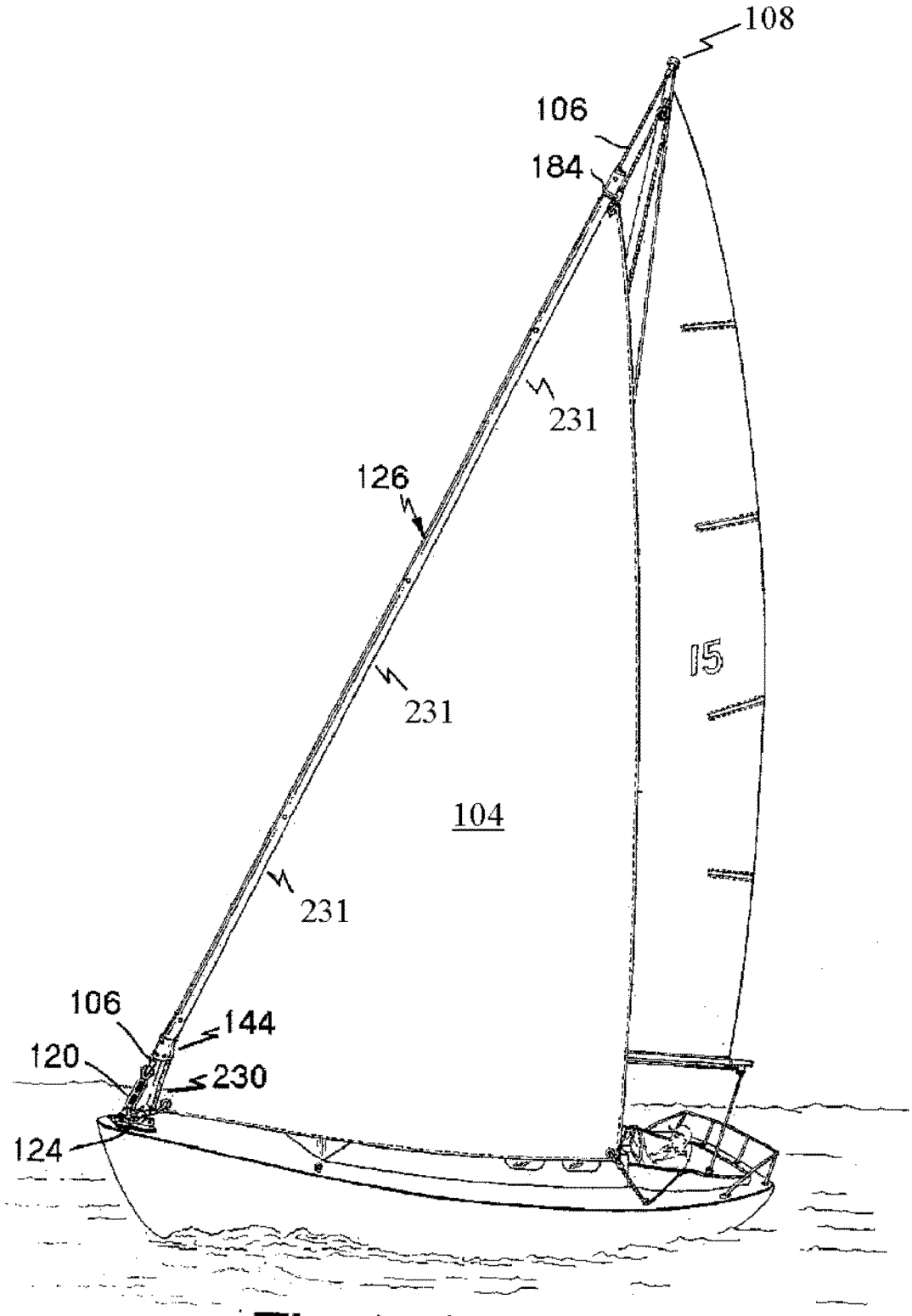
Fig 1. ( Prior Art)
FIG. 1 (Prior Art) depicts a prior art sailboat using a foil affixed to the headstay.
Figure 2:
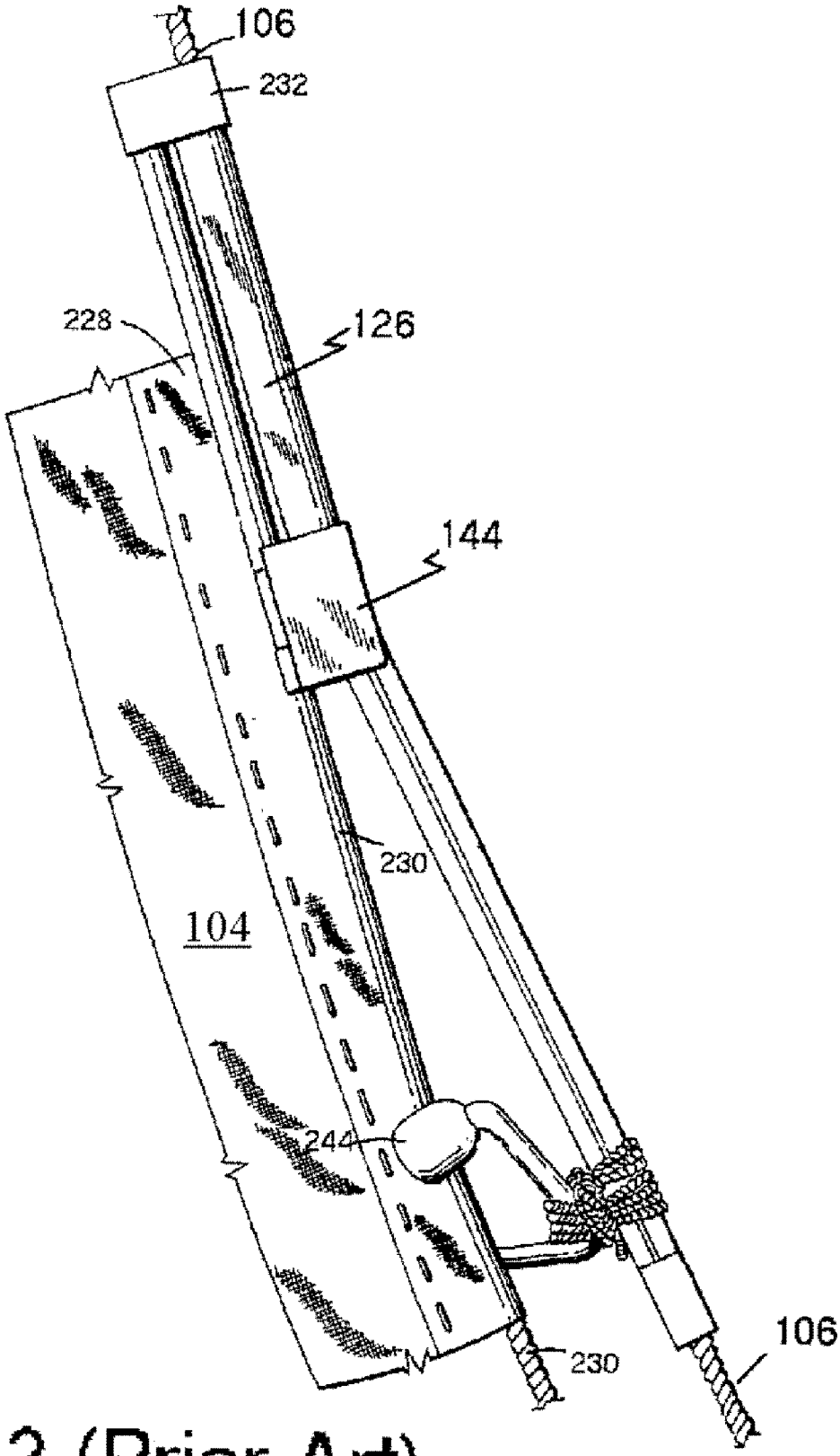
Fig. 2 (Prior Art)
FIG. 2 (Prior Art) depicts the luff of a jib entering a foil by means of feeder, and utilizing a pre-feeder.
Figure 3A:
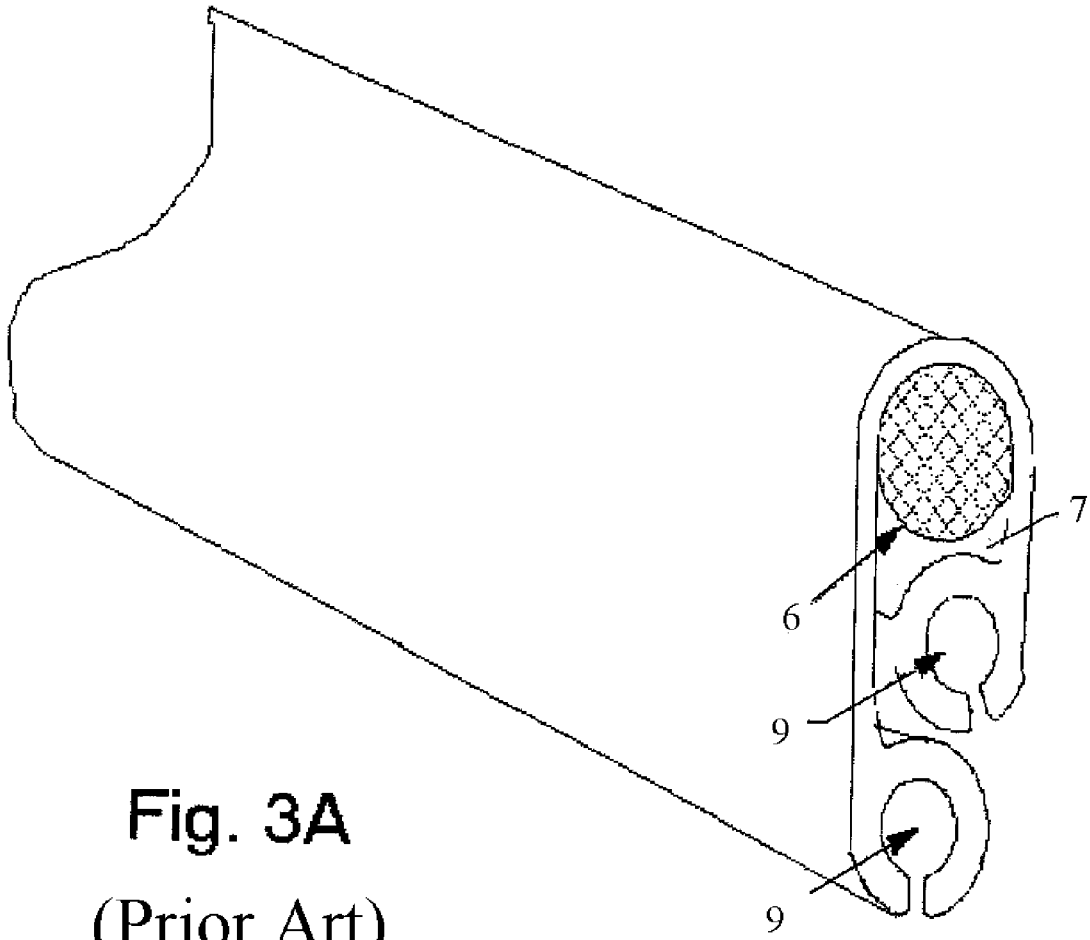
Fig. 3A (Prior Art)
FIG. 3A (Prior Art) depicts a perspective view of a prior art foil which is more or less constant over the length of the foil.
Figure 3B:
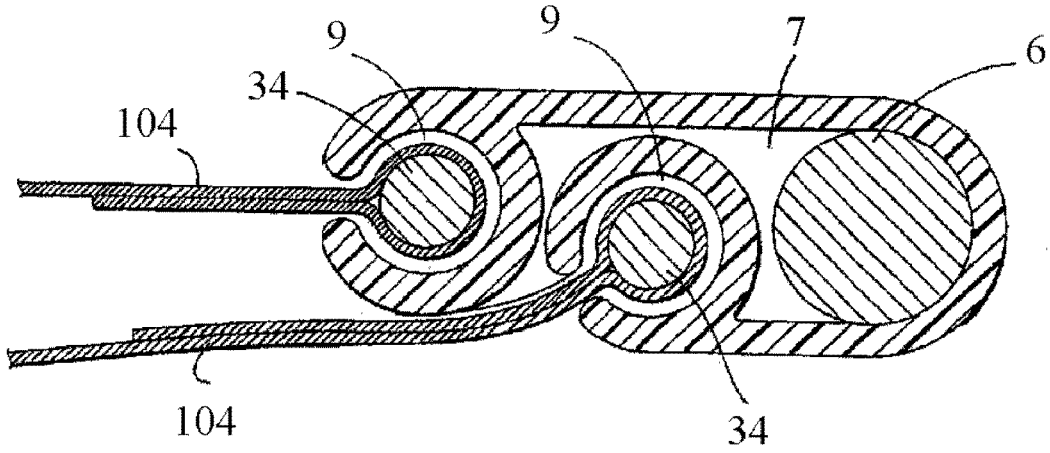
Fig. 3B (Prior Art)
FIG. 3B (Prior Art) depicts a cross-section view of a prior art foil whose width is more or less constant over the length of the foil.
Figure 3C:
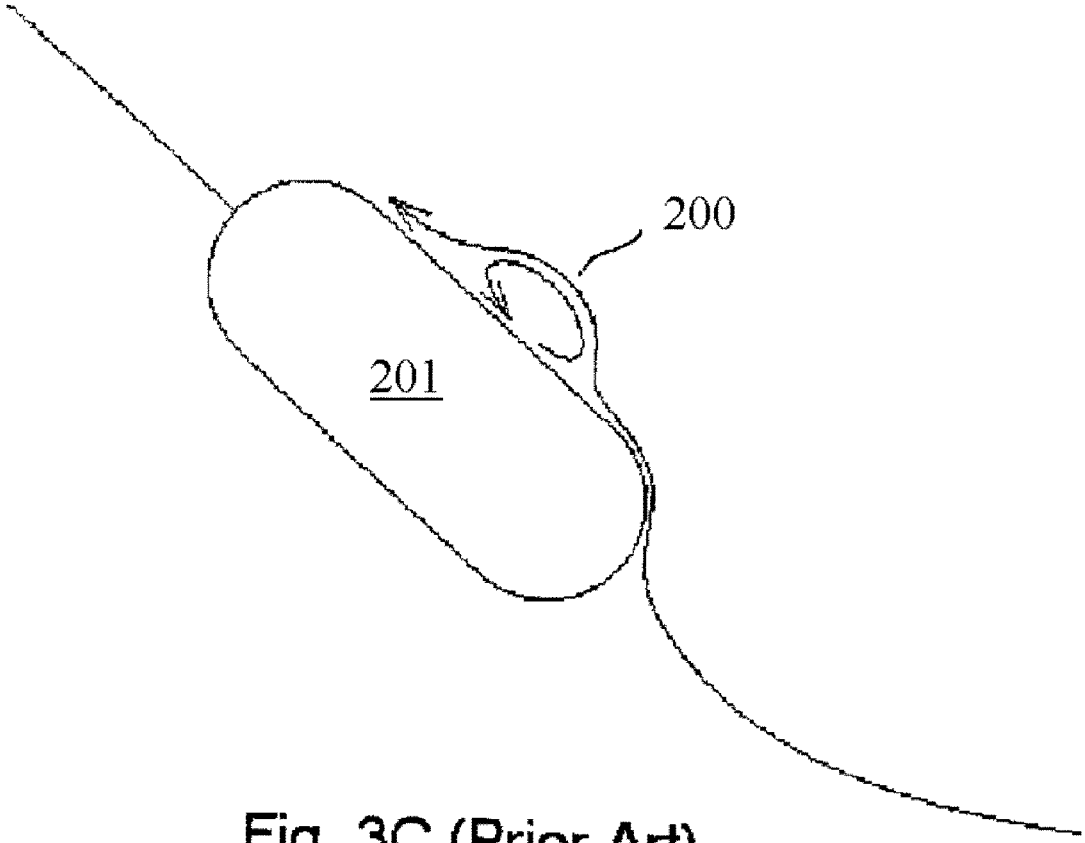
Fig. 3C (Prior Art)
FIG. 3C (Prior Art) depicts the airflow around the body of the prior art foil.

The nose of the current foil 28 is seen to be somewhat smaller that that of the prior art foils, such as that shown in FIG. 3B, which has a diameter approximately equal to the diameter of the headstay plus twice the width of the wall of the foil in proximity to the headstay. In contrast the foil of the present invention has a reduced diameter at the nose, as may be seen by reference to FIG. 6, wherein a copy of the headstay cross section 6 is superimposed 38 on the nose of the foil. From this figure it is clear that the diameter of the foil nose is approximately equal to that of the headstay itself.

Reduction of the nose diameter is accomplished by moving the headstay back from the nose, as seen in FIG. 5. This configuration results from slightly increasing the nose wall 28, compared to the side walls 22, and further adding the three nose tabs 20. The use of the tabs reduces the weight of the foil in the nose area, as compared to simply further widening the nose wall. The total effect is to push the headstay back from the nose of the foil by a distance approximately twice the width of the side walls 22.

A particular foil may be used with a range of different headstay sizes. In general, however, the minimum width of the foil at its widest point will be greater than the diameter of the maximum headstay size which the foil will accommodate. This minimum width is defined by the equation $$Wm=Dhm+2T$$

Where

Wm=minimum width at maximum point

Dhm=maximum headstay diameter

Tw=wall thickness

Furthermore the foil contains luff channels which add to the length. The headstay must clear the forward luff channel, and if a second luff channel exists, it also adds to the length of the foil. The luff channels have substantially circular cross sections, with an outer diameter of DIc, where $$Dlc=Dlb+2T$$

Where Dlb=diameter of luff bolt

The total length Lt of the foil may now be defined by $$Lt>Dhm+T+Nt+2Dlc+Flc$$

where Nt=length of nose tab

Flcr=length of rear luff channel fairing

The nose tabs are designed to push the fairing forward of the headstay, thereby increasing the aerodynamic characteristics of the foil. There are countervailing constraints on the length of this forward displacement due to the racing rules, however. It has been found by trial and error that an optimum distance is achieved when the combination of the nose tabs and nose wall are equal in length to the about twice the side wall thickness of the foil.

Figure 6:
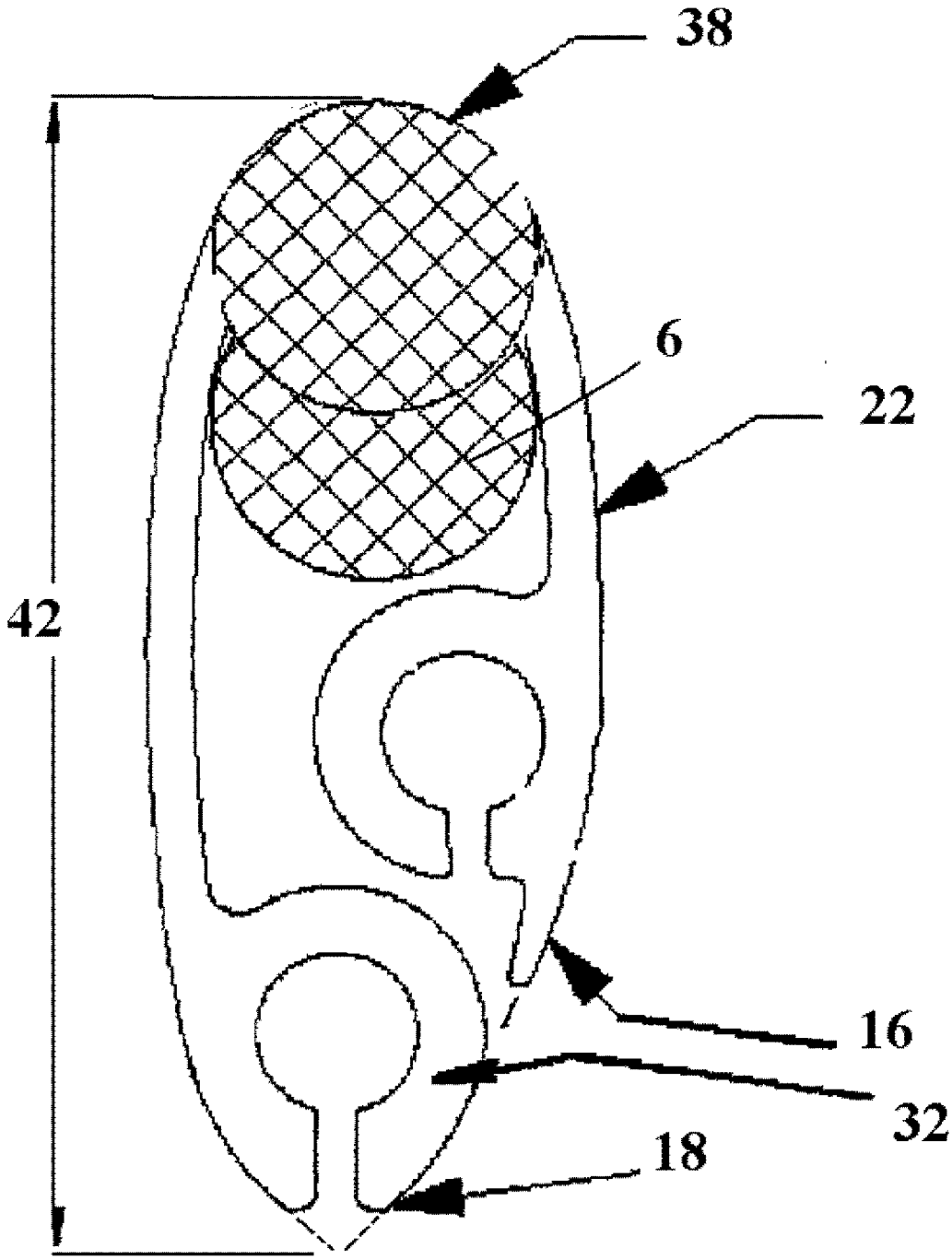
FIG. 6 depicts the present foil, showing the headstay superimposed on the nose of the foil.

Finally, the forward part of the foil, when viewed in cross section, must approximate a segment of a circle whose diameter is less than or equal to that of the largest headstay which can be used with the foil. This requirement is in contrast with the prior art foil, as seen in FIG. 6, whose nose section diameter is equal to the headstay diameter plus twice the wall thickness of the foil.

Thus the present invention is new and non-obvious not only because of its aerodynamic cross section, but because of the unique way in which the aerodynamic shape of the foil is incorporated into the configuration of the various channels of the foil.

Thus, taking all of these requirements together, the requirements of the present invention include:

(a) the foil must be reasonably aerodynamic, creating a laminar flow over the headsail, minimizing turbulence, and minimizing windage;

(b) it must have a nose diameter less than the maximum headstay size plus twice the wall thickness; and (c) its length must include the wall, nose tabs, forward and aft luff channels, and the aft fairing, used to minimize turbulence.

Thus the present invention is new and non-obvious in the detailed manner in which the cross section provides all these requirements. The resulting foil cross section is a distinct variation from the prior art. In the first instance, the present commercially offered foils are a substantially constant width over the entire foil, as may be seen in FIG. 3B. Furthermore, the shape of the present invention, although streamlined, departs substantially from the shape of streamlined foils found in the prior art, typified by the U.S. Pat. No. 5,109,787, which has a extended, sharply tapered aft section, and which more nearly typifies and air foil.

The critical aspects of the foil of this invention include the two luff channels for retaining the luff beads, as well as a channel for capturing the headstay, while still retaining an aerodynamic shape with a minimum amount of turbulence, and maintaining a laminar flow over the sail itself. That this form has accomplished the above requirements has been verified by wind chamber testing, as described above.

These two luff channels both have backward-disposed channels to allow access by the sails to the luff channels. A number of competing foils also allow for two headsails to be attached in dual channels, but many of these have channels which exit at angles that differ significantly from those dead aft of the foil. For good aerodynamic performance, it is essential that the sail exits as close to dead aft of the foil as possible. In this case the disposition of a second sail channel 26 behind the first sail channel 24 provides for an angle as close to dead aft as possible.

The resulting form is shown in FIG. 5 The foil has a wall with a more or less uniform thickness. Behind the forward section of the wall are the nose tabs 20 which push the headstay 6 forward. Rear of the headstay, the luff channels are connected by a single wall, which forms the headstay channel 7 as result of the disposition of the second luff channel 24 behind the first luff channel 26.

Additional fairings 18, close the exit 44 to the aft channel as much as possible, further minimizing the turbulence caused by such discontinuities of the surface. The forward channel 24 is configured so that its exit 36 is likewise smoothly formed into the overall profile, so that the overall aerodynamic effect of the exterior of the foil is maintained.

This foil is fabricated of a tough, flexible material, typically one of the thermosets or thermoplastics, which permits the second luff channel 26 being pulled away from the first luff channel 24 in order to permit the headstay to be "snapped" into the headstay channel 7. This feature is essential for the acceptance of the head foil in the yachting market, because complicated attachment features, which appear in many of the prior art foils, make them unacceptable to the consumers of these products. Prior art foils have been provided in two separate foil halves which, when snapped together, form the finished foil. However this two-piece version is clearly inferior to the one piece "snap-on" foil because of the latter's simplicity and reduced weight.

The form of the foil may be defined by specifying a number of discrete points about the periphery of the foil, and connecting these points in such a way that the result is a smooth, contoured form. If the number of points is sufficiently large the connection of points may be done with straight lines, without disturbing the aerodynamic properties of the foil. However, it has been found that the form may be sufficiently defined by 6 points at the periphery of the foil cross section to provide a reasonably good approximation.

Figures 7A, 7B:
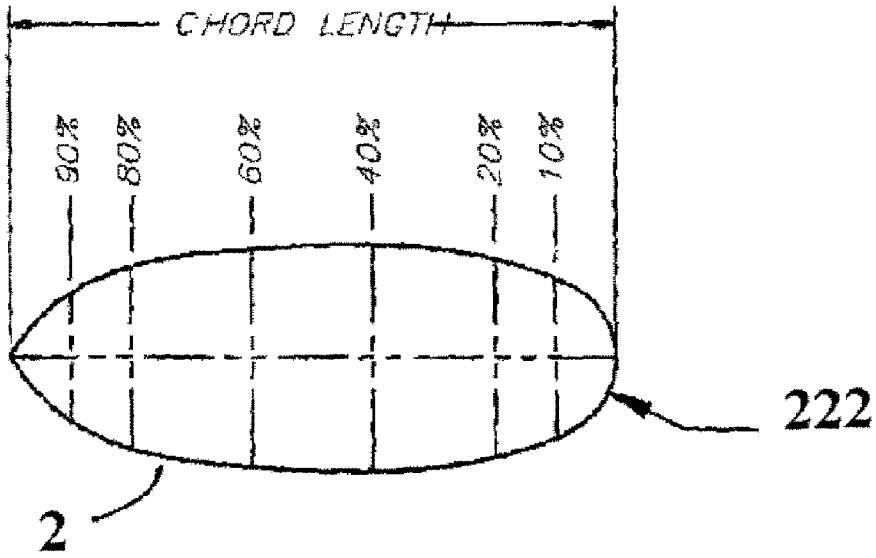
FIG. 7A depicts the cross section of the present foil, in outline only, showing locations of relative dimensions.
FIG. 7B depicts the relative dimensions of the foil of FIG. 7A, in tabular form.

Referring now to FIG. 7A, the outline of the foil 2 of the present invention is shown. The outline is assumed to be symmetrical about its long axis, of chord, which is defined as the length of the outline in the long axis direction, as shown in the figure.

In this figure, the nose radius is shown to be about 13% of the chord length, whereby the nose approximates a semi-circle of this nose radius. Widths of the outline are defined at 10%, 20%, 40%, 60%, 80%, and 90% of the chord length, as measured from the nose. The table of FIG. 7B defines the widths at these percentages of the chord length.

It can be seen by referring to this figure that the in outline between the 60% and 40% points the width deviates by only 2%. Furthermore, between the 20% and 40% points, there is a deviation of only 5%, while between the 60% and 80% points there is a deviation of only 6%. As a result, is believed that the outline can be sufficiently defined by these 6 points. This is especially true if the outline further conforms to one of the NACA standard aerodynamic forms.

These dimensions have been found to be subject to some variation, and it is believed that a tolerance of plus and minus ten percent will still provide superior performance. Even a tolerance of plus and minus 20% will provide a reasonable improvement over the prior art foils. The results are further enhanced when the outline is made to conform to one of the NACA standard profiles, within the tolerances stated above.

While the invention has been described with reference to specific embodiments, it will be apparent that improvements and modifications may be made within the purview of the invention without departing from the scope of the invention defined in the appended claims.

What is claimed is:

1. A foil for the headsail of a sailboat for use with a headstay, the foil comprising:

a) an aerodynamic shape;
b) a headstay channel for containing the headstay;
c) a first and second sidewall, each having a width w;
d) a forward wall having a width wf;
e) two or more tabs which have a width, when added to wf, approximately equals 2w;
f) a forward luff channel bounded on one side by the first side wall and on another side by a forward channel inner wall;
g) an aft luff channel bounded on one side by the second side wall and on another side by an aft channel inner wall;
h) a forward fairing tab affixed to an end of the first side wall; and
i) two aft fairing tabs, one affixed to an end of the second side wall, and the other affixed to an end of an aft channel inner wall.

2. The foil of claim 1, wherein the forward wall further comprises a diameter, said diameter being less than or equal to the diameter of the headstay.

3. The foil of claim 1 further comprising a chord length, wherein the diameter of the forward wall is 13% of the chord length, plus or minus ten percent.

4. The foil of claim 1, further comprising a chord length, wherein the diameter of the forward wall is 13% of the chord length, plus or minus twenty percent.

5. The foil of claims 1 or 2 or 3 or 4, wherein the foil further comprises a cross-sectional outline, the outline comprising a nose, a width and a major axis, the width having a value as follows, within plus or minus 10%, as measured as a length from the nose:

(a) 26% of the chord length at a distance of 10% chord length;
(b) 33% of the chord length at a distance of 20% chord length;
(c) 38% of the chord length at a distance of 40% chord length;
(d) 36% of the chord length at a distance of 60% chord length;
(e) 30% of the chord length at a distance of 80% chord length; and
(f) 21% of the chord length at a distance of 90% chord length.

6. The foil of claims 1 or 2 or 3, wherein the foil further comprises an outline, the outline comprising a nose, a width and a major axis, the width having a value as follows, within plus or minus 20%, as measured as a length from the nose:

(a) 26% of the chord length at a distance of 10% chord length;
(b) 33% of the chord length at a distance of 20% chord length;
(c) 38% of the chord length at a distance of 40% chord length;
(d) 36% of the chord length at a distance of 60% chord length;
(e) 30% of the chord length at a distance of 80% chord length; and
(f) 21% of the chord length at a distance of 90% chord length.

7. The foil of claims 1 or 2 or 3 or 4, wherein the foil outlines substantially conform to a NACA aerodynamic form.

8. The foil of claim 5, wherein the foil outlines substantially conform to a NACA aerodynamic form.

* * * * *

UNITED STATES PATENT AND TRADEMARK OFFICE

CERTIFICATE OF CORRECTION

PATENT NO. : 7,096,812 B1
APPLICATION NO. : 11/161038
DATED : August 29, 2006
INVENTOR(S) : Cook et al.

It is certified that error appears in the above-identified patent and that said Letters Patent is hereby corrected as shown below:

On the title page, Item (75) Inventors name "Paul Bogotaj" should read -- Paul Bogataj--.

Signed and Sealed this

Twenty-eighth Day of November, 2006

JON W. DUDAS
*Director of the United States Patent and Trademark Office*